US006000841A

United States Patent [19]

Cooke et al.

[11] Patent Number: 6,000,841

[45] Date of Patent: Dec. 14, 1999

[54] STATIC FLUID FLOW MIXING APPARATUS

[75] Inventors: Jeffrey A. Cooke; Glen D. Austin; Michael Jerome McGarrity, all of London, Canada

[73] Assignee: Labatt Brewing Company Limited, London, Canada

[21] Appl. No.: 09/144,173

[22] Filed: Aug. 31, 1998

Related U.S. Application Data

[63] Continuation of application No. 08/796,412, Feb. 6, 1997, Pat. No. 5,800,059, which is a continuation of application No. 08/438,235, May 9, 1995, abandoned.

[51] Int. Cl.[6] ..... B01F 5/00

[52] U.S. Cl. ..... 366/337; 366/337

[58] Field of Search ..... 366/337, 336; 138/40, 42; 250/435, 436, 437, 438

[56] References Cited

U.S. PATENT DOCUMENTS

| | | | |
|---|---|---|---|
| 3,051,453 | 8/1962 | Sluijters . | |
| 3,190,618 | 6/1965 | Katzen | 366/337 |
| 3,235,003 | 2/1966 | Smith | 138/38 X |
| 3,337,194 | 8/1967 | Zavasnik et al. . | |
| 3,567,921 | 3/1971 | Holiday | 250/45 |
| 3,620,506 | 11/1971 | So . | |
| 3,652,061 | 3/1972 | Chisholm . | |
| 3,657,087 | 4/1972 | Scott | 204/158 R |
| 3,733,057 | 5/1973 | Kahoun . | |
| 3,769,517 | 10/1973 | Coleman | 250/455 |
| 3,924,246 | 12/1975 | Scherer | 340/173 SP |
| 3,998,477 | 12/1976 | Delahaye et al. | 285/93 |
| 4,034,965 | 7/1977 | Graentzel | 250/431 |
| 4,072,296 | 2/1978 | Doom . | |
| 4,093,188 | 6/1978 | Horner . | |
| 4,112,520 | 9/1978 | Gilmore . | |
| 4,136,720 | 1/1979 | Kinney . | |
| 4,179,222 | 12/1979 | Strom et al. . | |
| 4,296,066 | 10/1981 | Schenck | 422/24 |
| 4,314,974 | 2/1982 | Libby et al. | 423/8 |
| 4,352,378 | 10/1982 | Bergmann et al. | 366/337 |
| 4,363,552 | 12/1982 | Considine | 366/340 |
| 4,497,753 | 2/1985 | Streiff | 261/95 |
| 4,498,786 | 2/1985 | Ruscheweyh | 366/337 |
| 4,600,544 | 7/1986 | Mix | 261/79.2 |
| 4,747,697 | 5/1988 | Kojima | 366/339 |
| 4,808,007 | 2/1989 | King | 366/337 |
| 4,929,088 | 5/1990 | Smith | 366/336 |
| 5,675,153 | 10/1997 | Snowball | 250/438 |

*Primary Examiner*—Tony G. Soohoo
*Attorney, Agent, or Firm*—Levy & Grandinetti

[57] ABSTRACT

A static mixer conduit comprises a longitudinally elongated conduit having tabs that are arranged with respective first edges adjacent the conduit wall and respective opposed second edges that are spaced radially inward from the conduit wall. These tabs are operable as fluid foils so that with fluid flowing through the conduit, greater fluid pressures manifest against the tab's upstream faces relative to reduced fluid pressures against their downstream faces. The resultant pressure difference in the fluid adjacent, respectively, the mutually opposed faces of each of the tabs causes a longitudinal flow of fluid through the conduit over and past each said tab to be redirected. As a result of the redirection, there is introduced a radial cross-flow component to the longitudinal flow of fluid through the conduit. In particular, the mixer further comprises a central body extending generally coaxially along at least a portion of the longitudinal extent of the conduit and defining between the central body's surface and the conduit wall an annular space confining the radial cross-flow. A method is also disclosed that comprises static mixing, over a longitudinal extent of a mixing volume having an annular cross-section, wherein radial cross-stream mixing in a longitudinal fluid flow results from flow-redirecting tabs redirecting a longitudinal fluid flow from an outer, fluid containment boundary surface, across an intervening space having an annular cross-section towards an inner boundary surface.

9 Claims, 2 Drawing Sheets

STATIC FLUID FLOW MIXING APPARATUS

This application is a continuation of U.S. application Ser. No. 08/796,412, filed on Feb. 6, 1997, and now U.S. Pat. No. 5,800,059, which is a continuation of U.S. application Ser. No. 08/438,235, filed on May 9, 1995, abandoned.

FIELD OF THE INVENTION

The present invention relates to static mixers, and especially to static mixers having both radial and longitudinal flow in an elongated fluid-mixing conduit.

BACKGROUND OF THE INVENTION

As a generalization, typical static mixers include fluid redirecting tabs, vanes, baffles, or the like, that are arranged in a fluid conduit and that are typically operable to divide, subdivide, separate adjacent subdivided flows, and then recombine the subdivided flows into a "shuffled" whole, as the fluid passes through that conduit.

In a departure from that more typical approach, U.S. Pat. No. 4,929,000 discloses a tab arrangement in a fluid conduit that has lower fluid back pressures than are associated with the more typical approach to more typical static mixer designs. In particular, this patented tab arrangement operates by creating radial vortex flow patterns that are generally transverse to the longitudinal flow through the fluid conduit in which these tabs are mounted. This results in a plurality of cross-stream mixing flows that are transverse to the longitudinal flow of the fluid along the length of the conduit. This approach is disclosed as an enhancement over the kind of mixing that would be expected to occur naturally in a conduit under turbulent fluid flow conditions.

SUMMARY OF THE INVENTION

In accordance with the present invention, there is provided a further improvement in static mixers—one in which a central elongated body is deployed within the static mixer conduit in a central region of reduced mixing. Such a region, for example, tends to exist between diametrically-opposed, radially-convergent, cross-stream mixing flows within that conduit. In any case, this centrally-located body occupies a zone in which there would otherwise be a reduced cross-flow. The presence of this central body results in the fluid flowing past it tending to be more efficiently mixed—in that there is less of a tendency for an unmixed "channel" of longitudinal fluid flow to establish itself within the center of the conduit.

In a particularly preferred embodiment according to the present invention, there is provided a static mixer conduit in which tabs are each arranged with respective (preferably leading, upstream) edges adjacent the conduit wall and respective (preferably trailing, downstream) opposed edges that are spaced radially inwardly from the conduit wall. These tabs are operable as fluid foils that, with fluid flowing through the mixer, have greater fluid pressures manifest against their upstream faces and reduced fluid pressures against their downstream faces. This pressure difference in the fluid adjacent, respectively, the mutually opposed faces of each of the tabs then causes the longitudinal flow over and past each tab to be redirected, thereby resulting in the addition of a radial cross-flow component to the longitudinal flow of fluid through the conduit.

The present invention further includes an improved method in which the static mixing is performed over a longitudinal extent of a mixing volume having an annular cross-section. More specifically, the method of the present invention relates to cross-stream mixing in a fluid flow, in which tabs mentioned herein redirect a longitudinal fluid flow from an outer, fluid containment boundary surface, across an intervening space having an annular cross-section towards an inner boundary surface. Preferably, the tabs are ramped and arranged in the fluid flow between the respective boundary surfaces to cause the fluid to flow over the edges of each such tab to deflect the generally longitudinal fluid flow inwardly from the fluid containment boundary surface, across the intervening space (having the aforesaid annular cross-section), towards an inner boundary surface. The inner boundary surface defines a volume, which, but for the presence of that surface, would permit passage of a central longitudinal flow of non-uniform fluid mixing.

In a particularly preferred form, the fluid flow over the edges of each tab results in the flow being deflected inward and up the inclined surface of the tab to generate a pair of tip vortices in the fluid flow past each tab. The vortices of each such pair have mutually opposed rotations, about an axis of rotation oriented generally along the longitudinal "stream-wise" fluid flow direction, along the annular space between the two boundary surfaces.

DETAILED DESCRIPTION OF A PREFERRED EMBODIMENT

Introduction to the Drawings

Figure 2:
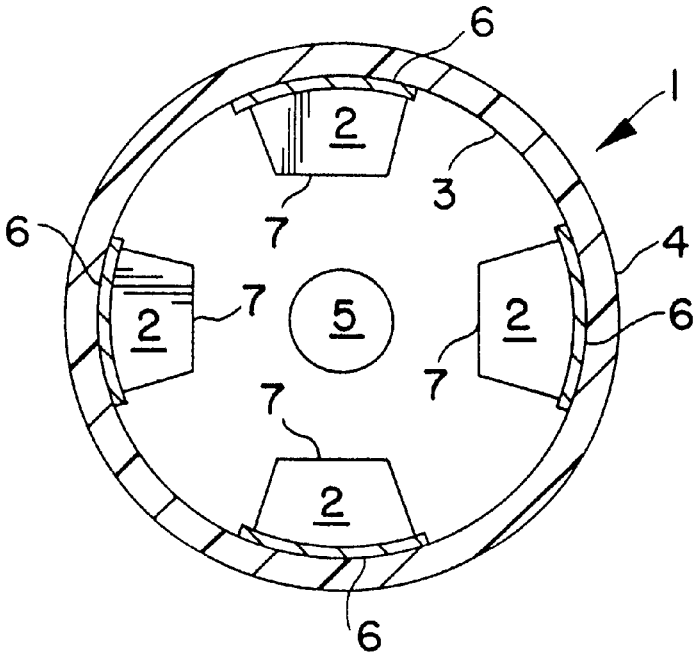
FIG. 2 is an elevated, transverse cross-section taken through line 2—2 of the mixer depicted in FIG. 1.
Figure 3:
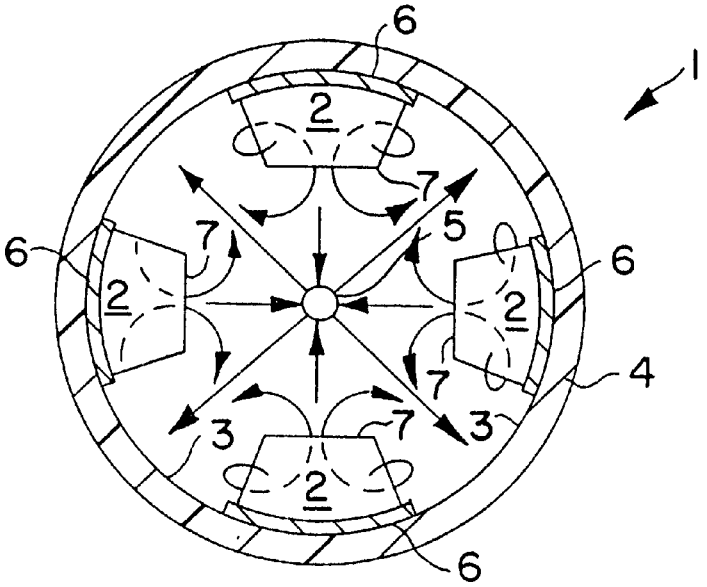
Figure 4:
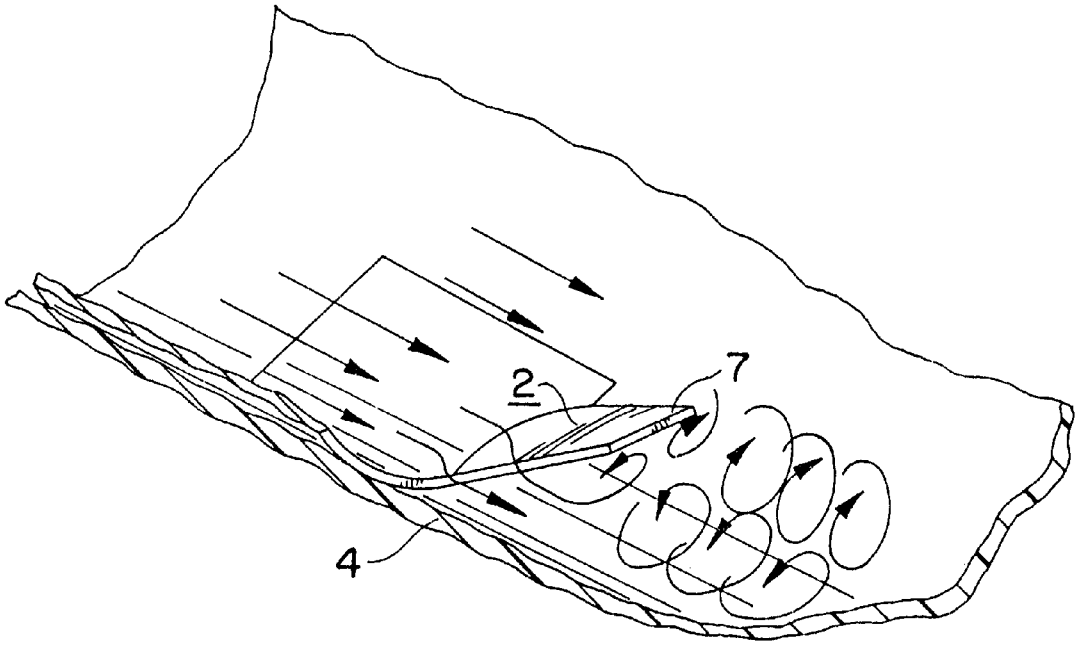

FIG. 3 is a reproduction of the view illustrated in FIG. 2, but further including representative fluid stream lines, to illustrate radial cross-flow patterns; and, FIG. 4 is a cut-away perspective view illustrating vortex flow downstream of a single, representative tab. (Note: The apparatus disclosed and illustrated in U.S. Pat. No. 4,929,088—Smith (dated Mar. 29, 1990), is useful as a component of the present invention, and the disclosure of that patent is hereby expressly incorporated herein, in its entirety. Similarly, the method described in U.S. Pat. No. 4,981,368 to Smith, (dated Jan. 1, 1991) is also hereby expressly incorporated herein, in its entirety.

Figure 1:
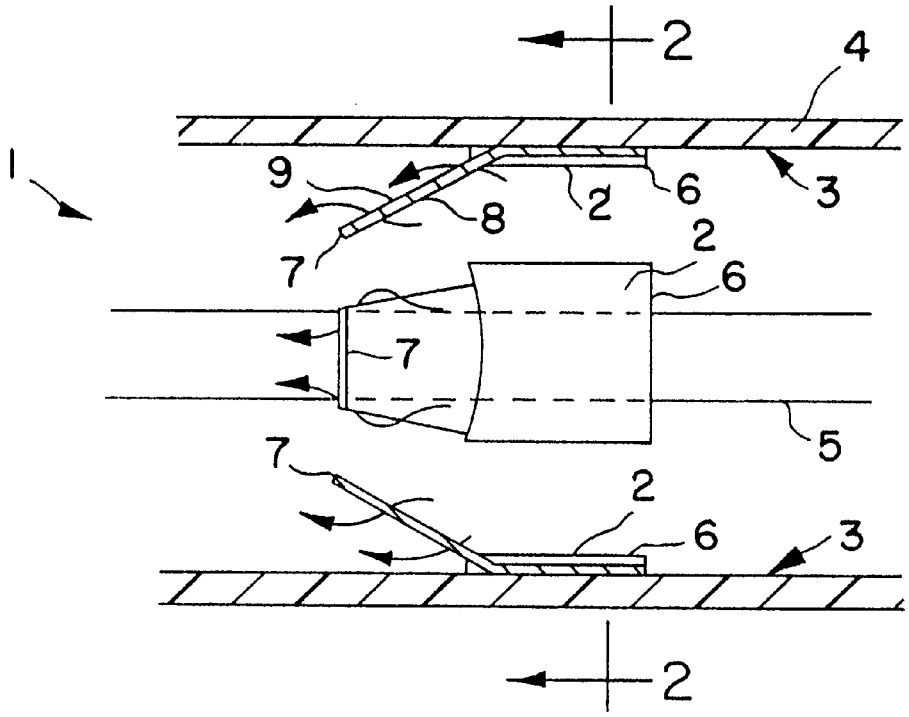
FIG. 1 is an elevated, longitudinal cross-section through a static mixer according to the combination of the present invention.

Referring now to FIGS. 1, 2 and 3, there is illustrated an embodiment according to the present invention, in which a static mixer 1 includes a series of tabs 2 that are secured to the side walls 3 of a conduit 4. A central body 5 is arranged in co-axially aligned relation, centrally within the interior of conduit 4, where it occupies a region of inefficient mixing.

In the illustrated embodiment, that region forms between diametrically-opposed, radially-convergent, cross-stream mixing flows (see FIG. 3, in particular) within conduit 4.

Static mixer 1 comprises conduit 4, in which tabs 2 are each arranged with respective (leading, upstream) edges 6 adjacent the conduit wall, and respective (trailing, downstream) opposed edges 7 that are spaced radially inwardly from the conduit wall 3. Tabs 2 operate as fluid foils which, with fluid flowing through the mixer, have greater fluid pressures manifest against their upstream faces 8 (see FIG. 1) and reduced fluid pressures against their downstream faces 9 (see FIG. 1). This pressure difference in the fluid adjacent, respectively, the mutually opposed faces of each of the tabs then causes the longitudinal flow over and past each tab to be redirected (as is illustrated by the various flow streamlines that are shown in the various figures), thereby resulting in the addition of a radial cross-flow component to the longitudinal flow of fluid through the conduit 4.

With body 5 occupying the zone of relatively poor mixing as described above, the fluid itself is precluded from forming eddies in that zone, in which the fluid would not be as thoroughly admixed with the balance of the fluid flow.

In a particularly preferred embodiment, body 5 comprises a heat transfer body adapted to exchange heat with the fluid passing through the conduit. This allows a manufacturer to not only to secure improved mixing as aforesaid, but also to increase the amount of heat exchange surface available to alter the temperature of the fluid flow. This is particularly advantageous since the benefit of avoiding boundary layer "insulation" effects as discussed in relation to the boundary surface described in U.S. Pat. No. 4,929,088, is true for both that boundary surface and for the heat exchange surface of the central body 5.

In a further embodiment according to the present invention, the central body 5 is a cross-flow filter element. As will be apparent to persons skilled in the art, in light of the present invention, the boundary layer advantages associated with thermal transfer are applicable in achieving cross-flow filtration advantages too.

In operation, the improved static mixing according to the present invention is performed over a longitudinal extent of a mixing volume having an annular cross-section located between the central body 5 and side walls 3 of conduit 4. More specifically, there is cross-stream mixing in the longitudinal fluid flow through the present apparatus, in which tabs 2 redirect a longitudinal fluid flow from the outer, fluid containment, boundary surface of side walls 3, across an intervening space having an annular cross-section towards the inner boundary surface defining the outermost extent of central body 5. Preferably, tabs 2 are ramped and arranged in the fluid flow between the respective boundary surfaces of side walls 3 and central body 5 to cause the fluid to flow over the edges of each tab 2 to deflect the generally longitudinal fluid flow radially inwardly from the fluid containment boundary surface of side wall 3, across the intervening space (having the aforesaid annular cross-section), towards an inner boundary surface defined by the outermost surface of central body 5. The inner boundary surface of central body 5 circumscribes a volume that, which but for the presence of that surface, would permit passage of a central longitudinal flow of substantial, relatively non-uniform mixing.

In a particularly preferred form the fluid flow over the edges of each tab results in the flow being deflected inward and up the inclined surface of the tab to generate a pair of tip vortices in the fluid flow past each tab. The vortices of each such pair have mutually opposed rotations, about an axis of rotation oriented generally along the longitudinal "stream-wise" fluid flow direction, along the annular space between the two boundary surfaces.

We claim:

1. A static mixer conduit comprising a longitudinally elongated conduit having tabs that are secured to a conduit wall and that are arranged with respective first edges adjacent said conduit wall, and respective opposed second edges that are spaced inwardly from the conduit wall, wherein said tabs are operable as fluid foils which, with fluid flowing through said mixer conduit, have greater fluid pressures manifest against their upstream faces and reduced fluid pressures against their downstream faces, and wherein a resultant pressure difference in said fluid adjacent, respectively, mutually opposed faces of each of said tabs causes a longitudinal flow of fluid through said conduit over and past each said tab, to be redirected, thereby resulting in the addition of a cross-flow component to the longitudinal flow of fluid through said mixer conduit, said mixer conduit further comprises a motionless central body extending generally coaxially along at least a portion of said longitudinally elongated conduit.

2. The static mixer conduit of claim 1 wherein said body comprises a heat transfer body adapted to exchange heat with said fluid passing through said mixer conduit.

3. The static mixer conduit of claim 1 wherein said central body comprises a cross-flow filter element.

4. A flow-through reactor for treating a fluid therein, said reactor comprising:

A) a fluid conducting channel;

B) a central body providing an inner boundary surface substantially centrally located within said channel; and C) static fluid-dynamic-effector means positioned in said channel for deflecting the flow of a fluid through said channel, said effector means comprising a plurality of motionless, ramped tabs having inclined surfaces and trailing downstream edges directed inwardly into said channel toward said inner boundary surface to permit a longitudinal fluid flow in a space between said downstream edges and said inner boundary surface, said tabs providing cross-stream mixing in said longitudinal fluid flow by deflecting said fluid over said edges of each of said tabs inwardly and upwardly along said inclined surface toward said inner boundary surface thereby generating a pair of tip vortices in said longitudinal fluid flow past each tab, each vortex of each of said pair of tip vortices being mutually opposed in rotation about an axis of rotation oriented along said longitudinal fluid flow and along said space between said edges and said inner boundary surface.

5. The reactor of claim 4 wherein the central body is a heat transfer body.

6. The reactor of claim 4 wherein the central body is a cross-flow filter element.

7. A method for treating a fluid comprising flowing said fluid through a flow-through reactor, said reactor comprising:

A) a fluid conducting channel;

B) a central body providing an inner boundary surface substantially centrally located within said channel; and C) static fluid-dynamic-effector means positioned in said channel for deflecting the flow of a fluid through said channel; said effector means comprising a plurality of motionless, ramped tabs having inclined surfaces and trailing downstream edges directed inwardly into said channel toward said inner boundary surface to permit a longitudinal fluid flow in a space between said downstream edges and said inner boundary surface, said tabs providing cross-stream mixing in said longitudinal fluid flow by deflecting said fluid over said edges of each of said tabs inwardly and upwardly along said inclined surface toward said inner boundary surface thereby generating a pair of tip vortices in said longitudinal fluid flow past each tab, each vortex of each of said pair of tip vortices being mutually opposed in rotation about an axis of rotation oriented along said longitudinal fluid flow and along said space between said edges and said inner boundary surface.

8. The method of claim 7 wherein the central body is a heat transfer body.

9. The method of claim 7 wherein the central body is a cross-flow filter element.

* * * * *